US008863897B2

(12) United States Patent
Bertolini et al.

(10) Patent No.: US 8,863,897 B2
(45) Date of Patent: Oct. 21, 2014

(54) AUTOMOTIVE NOISE ATTENUATING TRIM PART

(75) Inventors: Claudio Bertolini, Sesto San Giovanni (IT); Claudio Castagnetti, Stallikon (CH); Marco Seppi, Sr., Wallisellen (CH)

(73) Assignee: Autoneum Management AG, Winterthur (CH)

( * ) Notice: Subject to any disclaimer, the term of this patent is extended or adjusted under 35 U.S.C. 154(b) by 0 days.

(21) Appl. No.: 14/004,010

(22) PCT Filed: Mar. 9, 2011

(86) PCT No.: PCT/EP2011/053570

§ 371 (c)(1), (2), (4) Date: Oct. 3, 2013

(87) PCT Pub. No.: WO2012/119654

PCT Pub. Date: Sep. 13, 2012

(65) Prior Publication Data

US 2014/0014438 A1 Jan. 16, 2014

(51) Int. Cl.

| | |
|---|---|
| ***F02B 77/13*** | (2006.01) |
| ***G10K 11/168*** | (2006.01) |
| ***G10K 11/00*** | (2006.01) |
| *F02B 77/11* | (2006.01) |
| *G10K 11/16* | (2006.01) |

(52) U.S. Cl.

CPC ..... *G10K 11/002* (2013.01); *G10K 11/168* (2013.01)

USPC ..... 181/290; 181/286; 181/205; 181/204; 296/39.3

(58) Field of Classification Search

USPC ..... 181/290, 291, 286, 205, 204; 296/39.3, 296/39.1, 181.6, 211

See application file for complete search history.

(56) References Cited

U.S. PATENT DOCUMENTS

| | | | | | |
|---|---|---|---|---|---|
| 3,087,566 | A | * | 4/1963 | Watters | 181/286 |
| 4,106,588 | A | * | 8/1978 | Moore et al. | 181/284 |
| 4,940,112 | A | * | 7/1990 | O'Neill | 181/290 |
| 5,304,415 | A | * | 4/1994 | Kurihara et al. | 428/328 |

(Continued)

FOREIGN PATENT DOCUMENTS

| | | | | |
|---|---|---|---|---|
| EP | 1612768 | A1 | 1/2006 | |
| EP | 1742048 | A1 * | 1/2007 | G01N 29/11 |

(Continued)

OTHER PUBLICATIONS

International Search Report for International Application No. PCT/EP2011/053570, dated Nov. 18, 2011, (5 total pages).

(Continued)

*Primary Examiner* — Edgardo San Martin

(74) *Attorney, Agent, or Firm* — Finnegan, Henderson, Farabow, Garrett & Dunner, LLP

(57) ABSTRACT

A sound attenuating trim part, including at least one insulating area with an acoustic mass-spring characteristics having at least a mass layer and a decoupling layer adjacent to the mass layer, whereby the mass layer consists of a porous fibrous layer and a barrier layer, with the barrier layer being located between the porous fibrous layer and the decoupling layer and all layers are laminated together, and whereby the porous fibrous layer at least in the insulating area has adjusted dynamic Young's modulus (Pa) such that the radiation frequency of is at least 3000 (Hz).

10 Claims, 3 Drawing Sheets

(56) References Cited

U.S. PATENT DOCUMENTS

| | | | | |
|---|---|---|---|---|
| 5,536,556 | A * | 7/1996 | Juriga | 428/138 |
| 5,892,187 | A * | 4/1999 | Patrick | 181/286 |
| 5,923,002 | A * | 7/1999 | McGrath et al. | 181/290 |
| 6,145,617 | A | 11/2000 | Alts | |
| 6,878,432 | B2 * | 4/2005 | Ueda et al. | 428/174 |
| 6,955,845 | B1 * | 10/2005 | Poole et al. | 428/76 |
| 6,971,475 | B2 * | 12/2005 | Tompson et al. | 181/204 |
| 6,983,822 | B2 * | 1/2006 | O'Regan et al. | 181/290 |
| 7,318,498 | B2 * | 1/2008 | Woodman et al. | 181/290 |
| 7,677,358 | B2 * | 3/2010 | Tocchi et al. | 181/290 |
| 7,789,196 | B2 * | 9/2010 | Fukuhara et al. | 181/286 |
| 8,066,097 | B2 * | 11/2011 | Boyadjian et al. | 181/290 |
| 8,091,685 | B2 * | 1/2012 | Nakamura et al. | 181/286 |
| 8,109,361 | B2 * | 2/2012 | Tsugihashi et al. | 181/207 |
| 8,256,572 | B2 * | 9/2012 | Castagnetti et al. | 181/290 |
| 8,261,876 | B2 * | 9/2012 | Castagnetti et al. | 181/290 |
| 8,360,201 | B2 * | 1/2013 | Tanase | 181/291 |
| 8,590,669 | B2 * | 11/2013 | Wyerman et al. | 181/290 |
| 8,590,670 | B1 * | 11/2013 | Grube et al. | 181/291 |
| 8,627,922 | B2 * | 1/2014 | Fournier et al. | 181/294 |
| 8,636,105 | B2 * | 1/2014 | Castagnetti et al. | 181/290 |
| 8,636,106 | B2 * | 1/2014 | Castagnetti et al. | 181/290 |
| 2004/0075290 | A1 * | 4/2004 | Campbell | 296/39.3 |
| 2004/0131836 | A1 * | 7/2004 | Thompson | 428/304.4 |
| 2006/0113146 | A1 * | 6/2006 | Khan et al. | 181/286 |
| 2006/0201741 | A1 * | 9/2006 | Inoue et al. | 181/204 |
| 2008/0067002 | A1 * | 3/2008 | Pfaffelhuber et al. | 181/290 |
| 2008/0073146 | A1 * | 3/2008 | Thompson et al. | 181/291 |

FOREIGN PATENT DOCUMENTS

| | | | |
|---|---|---|---|
| EP | 2159786 | A1 | 3/2010 |
| FR | 2908550 | A1 | 5/2008 |
| WO | WO 2006/007275 | A1 | 1/2006 |

OTHER PUBLICATIONS

Bertolini, et al., Transfer Function Based Method to Identify Frequency Dependent Young's Modulus, Poisson's Ratio and Damping Loss Factor of Poroelastic Materials, *Symposium on acoustics of poro-elastic materials* (*SAPEM*), Bradford, Dec. 2008.

Langlois, et al., Polynomial Relations for Quasi-Static Mechanical Characterization of Isotropic Poroelastic Materials, *J. Acoustical Soc. Am.* 2001, vol. 10, No. 6, p. 3032-3040.

Brouard B., et al., A General Method of Modelling Sound Propagation in Layered Media, *Journal of Sound and Vibration*, 1995, vol. 183, No. 1, p. 129-142.

* cited by examiner

AUTOMOTIVE NOISE ATTENUATING TRIM PART

CROSS REFERENCE TO RELATED APPLICATIONS

This application is a national phase application based on PCT/EP2011/053570, filed Mar. 9, 2011, the content of both of which is incorporated herein by reference.

TECHNICAL FIELD

The disclosure relates to an automotive trim part for noise attenuation in a vehicle,

BACKGROUND ART

The sources of noise in a vehicle are many and include, among others, power train, driveline, tire contact patch (excited by the road surface), brakes, and wind. The noise generated by all these sources inside the vehicle's cabin covers a rather large frequency range that, for normal diesel and petrol vehicles, can be as high as 6.3 kHz (above this frequency, the acoustical power radiated by the noise sources in a vehicle is generally negligible). Vehicle noise is generally divided into low, middle and high frequency noise. Typically, low frequency noise can be considered to cover the frequency range between 50 Hz and 500 Hz and is dominated by "structure-borne" noise: vibration is transmitted to the panels surrounding the passengers' cabin via a variety of structural paths and such panels then radiate noise into the cabin itself. On the other hand, typically high-frequency noise can be considered to cover the frequency range above 2 kHz. High-frequency noise is typically dominated by "airborne" noise: in this case the transmission of vibration to the panels surrounding the passengers' cabin takes place through airborne paths. It is recognized that a grey area exists, where the two effects are combined and neither of the two dominates. However, for passenger comfort, it is important that the noise is attenuated in the middle frequency range as well as in the low and high frequency ranges.

For noise attenuation in vehicles, including cars and trucks, it is well known to use insulators, dampers, and absorbers to reflect and dissipate sound, and thus reduce the overall interior sound level.

Insulation is traditionally obtained by means of a "mass-spring" barrier system including a mass element and a spring element. The mass element is formed from a layer of high density impervious material, normally designated as a heavy layer, and the spring element is formed from a layer of low density material, for example a non-compressed felt or foam.

The term "mass-spring" is commonly used to define a barrier system that provides sound insulation through the combination of two elements, the "mass" and "spring". A part or a device is said to work as a "mass-spring" if its physical behaviour can be represented by the combination of a mass element and a spring element. These mechanical components of the mass-spring system, which are bonded together, allow the system to act as a sound insulator.

A traditional mass-spring system is normally put in a car on top of a steel layer, with the spring element in contact with the steel. The complete system (mass-spring plus steel layer) has the characteristics of a double partition. An insertion loss quantity describes how effective the mass-spring system is when put on top of the steel layer, independently from the insulation provided by steel layer itself. The insertion loss therefore shows the insulation performance of the mass-spring system.

A theoretical insertion loss curve (IL, measured in dB) includes particular features that characterize a mass-spring system. With regard to frequency, the curve increases with the frequency in an approximately linear fashion, and the rate of growth is about 12 dB/octave. This linear trend is considered very effective to guarantee a good insulation against incoming sound waves and, for this reason, mass-spring systems have been widely used in the automotive industry. This trend is achieved only above a certain frequency value, called "resonance frequency of the mass-spring system", at which the system is not effective as a sound insulator. The resonance frequency depends mainly on the weight of the mass element (the higher the weight, the lower the resonance frequency) and on the stiffness of the spring (the higher the stiffness, the higher the resonance frequency). At the resonance frequency of the mass-spring system, the spring element transmits the vibration of the underlying structure to the mass element in a very efficient way. At this frequency, the vibration of the mass element is even higher than that of the underlying structure, and thus the noise radiated by the mass element is even higher than the one that would be radiated by the underlying structure without the mass-spring system. As a consequence, around the resonance frequency of the mass-spring system, the IL curve has a negative minimum.

The insulation performance of an acoustical barrier is assessed by sound transmission loss (TL). The ability of an acoustical barrier to reduce the intensity of the noise being transmitted depends on the nature of the materials forming the barrier. An important physical property controlling sound TL of an acoustical barrier is the mass per unit area of its component layers. For best insulating performance, the heavy layer of a mass-spring system will often have a smooth high-density surface to maximize reflection of noise waves, a non-porous structure, and comprise a material of sufficient stiffness to minimize vibration.

Typical classical mass layers are made of highly filled dense materials, such as EPDM, EVA, PU, PP etc. These materials have a high density, normally above 1000 (kg/m$^3$), a smooth surface to maximize reflection of noise waves, a non-porous structure, and a certain stiffness to minimize vibration. It is known that many textile fabrics, either thin and/or porous in structure, are not ideal for noise insulation.

Absorption is usually obtained by the use of porous layers. The absorbing performance of an acoustical system is assessed by the absorption coefficient (a dimensionless quantity). Absorbers are commonly made of open porous materials, for example felt or foams.

Both absorbing and insulating systems work optimally only within a small bandwidth of frequencies. An absorber generally works better in higher frequencies, while an insulator generally works better in lower frequencies. Furthermore, both systems are sub optimal for use in a modern vehicle. The effectiveness of an insulator is strongly dependent on its weight, the higher the weight the more effective the insulator. The effectiveness of an absorber, on the other hand, is strongly dependent on the thickness of the material, the thicker the better. Both thickness and weight are becoming increasingly restricted, however. For example, additional weight of the insulator negatively impacts the vehicle's fuel economy, and the additional thickness of the absorber material-affects the vehicle's spaciousness.

Traditional insulators of the mass-spring type typically include a mass layer that is not porous, and therefore have low absorption, close to zero. The mass spring system only shows a noticeable absorption peak in a narrow band around the resonance frequency. However the absorption peak is in the low frequency region and not in the area of interest for absorption, which is the middle and high frequency region.

In the past, many attempts have been made at optimizing the sound insulation in a vehicle in such a way to reduce its mass (weight) while keeping the same level of acoustic comfort. The-potential for such a weight optimization is mainly-found in the heavy layer, and therefore, the optimization attempts have concentrated on reducing the mass of the heavy layer. However, these attempts have shown that if the weight of the heavy layer is reduced beyond a certain physical limit, the insulation system does not behave as a mass-spring system any longer and a loss of acoustic comfort inevitably occurs. In recent years, additional absorbing material was added to compensate for this loss of acoustic comfort.

Traditionally, one method to reduce the weight of the heavy layer included using fully porous systems. However porous absorbers have a very low acoustic insulation. For a porous system, the IL curve increases with the frequency in an approximately linear way, but only with a growth rate of about 6 dB/Octave instead of the 12 dB/Octave that can be observed when using an impervious barrier material like a heavy layer.

Another common practice for dealing with the above mentioned problem has consisted in putting an absorbing material on top of a mass spring system. With such a configuration, it is expected that the presence of the additional material would mainly add absorbing properties to the sound attenuating system. Additionally, it is also expected that the additional material would positively impact the acoustic insulation of the underlying mass-spring system since the material increases the overall weight of the system.

Products of this type are often referred to as ABA (Absorber-Barrier-Absorber) systems. Most of the ABA systems are made with foam or felt as a first absorbing layer, a barrier for example in the form of a heavy layer material as discussed, and an absorbing layer that functions also as a spring layer for the mass spring system. Also this absorbing layer typically includes a felt or foam. The barrier layer, together with the absorbing layer directly in contact with the structure on which the system is applied, should function as a mass spring system. The top absorbing layer should function as an additional sound absorber.

It is expected that when additional weight is put on top of a mass-spring system, such additional weight should affect the insulation performance of the system positively; for instance, an addition of 250 (g/m$^2$) of material on top of a mass spring system with a 2 (kg/m$^2$) heavy layer should give an overall IL increase of approximately 1 (dB), while an addition of 500 (g/m$^2$) of material on top of the same system should already give an IL increase of 2 dB. An IL increase of more than 1 dB is normally considered relevant for the overall noise attenuation in the passenger compartment of a vehicle. For a (kg/m$^2$) heavy layer, already an addition of 150 (g/m$^2$) of material should give such a 1 (dB) effect.

Surprisingly, it was found that when an absorbing layer is added on top of a mass-spring system to obtain an ABA system with a heavy layer as a barrier, the increase in the system's IL is much lower than what would be expected from the added weight. In many cases, the addition of the absorbing layer leads even to a reduction of the system's IL.

Many applications of ABA systems use a very soft felt (commonly designated as "fleece"), with an area weight between 400 and 600 g/m$^2$, as an absorbing top layer. This felt absorber is mechanically very soft (its compression Young's modulus is very low, typically much lower than the one of standard air), and does not participate actively in the insulating function of the system. Specifically, the link between the fibres of the absorber and the underlying heavy layer is not strong enough to affect the mass of the system. As a result, the addition of the absorber does not lead to any increase in the system's IL, and the system's insulation function is determined only by the mass of the heavy layer that is put on top of the decoupling layer. Very soft felt materials (or "fleeces") are more expensive than common thermo formable fibrous materials and therefore are normally only applied in the form of patches on top of the mass-spring system. Such application has to be accomplished manually and this can be an expensive operation.

As an alternative, the ABA system can be obtained by moulding or gluing a more traditional thermo-formable felt with, for example, an area weight between 500 and 2000 (g/m$^2$) on top of the heavy layer, to act as an absorber. Unexpectedly, it was found that this top absorbing layer has a negative effect on the insulation performance of the underlying mass-spring system, producing a deterioration of its IL curve. Such deterioration is caused by the noise radiation of the system formed by the heavy layer and the absorbing top layer. In fact, a specific frequency exists, radiation frequency, at which vibrations are transmitted by the heavy layer to the top absorbing layer in a very efficient way, thus making the top absorbing layer radiate noise. At the radiation frequency, the top surface of the top absorbing layer vibrates more than the underlying heavy layer. Due to this effect, the insertion loss of the ABA system is strongly compromised in the frequency range around the radiation frequency. In this frequency range, the IL of the ABA system is lower than the IL of the mass-spring system from which it is obtained. In this way, the addition of an acoustic function (absorption, via the absorber added on top) significantly deteriorates the original function of the system, i.e. insulation. The acoustic radiation of the system formed by the heavy layer and the top porous layer together deteriorates the insulation of the system, a case that was not considered previously in the state of the art.

SUMMARY OF INVENTION

It is object of the present disclosure to obtain a sound attenuating trim part, which works over the range of frequencies important for noise reduction in a vehicle, without the drawbacks of the state of the art. In particularly to optimize the weight use for noise attenuation.

In one embodiment, a sound attenuating trim part may comprise at least one insulating area having acoustic mass-spring characteristics and comprising a mass layer and a decoupling layer. The mass layer may be adjacent to the decoupling layer and may comprise a porous fibrous layer and a barrier layer. The barrier layer may be located between the porous fibrous layer and the decoupling layer, and all layers may be laminated together. The porous fibrous layer at least in the insulating area may be adjusted to have a dynamic Young's modulus (Pa) of at least $$4\pi^2 \cdot 10^{-6} \cdot t_p \cdot v^2 \cdot \frac{\frac{AW_b \cdot AW_p}{3} + \frac{AW_p^2}{12}}{AW_b + AW_p}$$

where $AW_b$, is an area weight (g/m$^2$) of the barrier layer, $AW_p$ is an area weight (g/m$^2$) of the porous fibrous layer, is a thickness (mm) of the porous fibrous layer and v (Hz) is a radiation frequency of at least 3000 (Hz), and the barrier layer has an area weight of at least 400 (g/m$^2$).

For the passenger compartment of a vehicle, sound insulating trim parts are the most effective. An ideal mass-spring system will show an IL curve with a 12 dB/Octave growth rate. Only the actual weight used in the mass layer is decisive of the overall insulation obtained. To obtain this same growth rate with an ABA system, the radiation frequency v must be above the upper frequency limit of the frequency range of interest, in this case at least above 3000 (Hz), preferably above 4000 (Hz) or more preferably above 5000 (Hz) although this limit depends on the application.

It was found that there is a relationship between the dynamic Young's modulus of the material constituting the porous fibrous layer and the radiation frequency. This relationship depends parametrically on the area weight and thickness of the porous fibrous layer, and on the area weight of the barrier layer. Additionally, the radiation frequency must not be too high to deteriorate the overall insulation performance of the underlying mass-spring system. In one embodiment, the radiation frequency is at least above 3000 (Hz) and therefore the dynamic Young's modulus E must be at least approximately $$4\pi^2 \cdot 10^{-6} \cdot t_p \cdot v^2 \cdot \frac{\frac{AW_b \cdot AW_p}{3} + \frac{AW_p^2}{12}}{AW_b + AW_p}.$$

This can be achieved for instance by a proper choice of the material, of its area weight, of its thickness and of the level of compression needed. Not every material will achieve the necessary Young's modulus.

By adjusting the dynamic Young's modulus of the material constituting the porous fibrous layer in such a way that it is above the minimum Young's modulus necessary for the radiation frequency to lie outside of the frequency range of interest, the 12 dB/Octave growth rate can be obtained in the IL curve of the system. In this way, the IL curve of the ABA system behaves qualitatively similarly to the IL curve of the underlying mass-spring system. At the same time, it is also observed that the IL curve of the ABA system according to the invention is higher than the IL curve of the underlying mass-spring system, the difference being due to the additional weight of the porous fibrous layer. In this way, the porous fibrous layer contributes to the insulation function of the system, and the full mass potential of the mass layer consisting of the barrier layer and the porous fibrous layer can be used for the insulating properties of the trim part. At the same time the porous fibrous layer with the adjusted Young's modulus maintains absorbing properties.

The absorbing top layer in the form of the porous fibrous layer with the Young's modulus, according to the present disclosure increases the quantity of material that actively participates to the mass-spring effect.

By using the ABA according to the present disclosure it is now possible to tune or adjust a trim part for any particular vehicle application, in particularly inner dash or floor covering systems. The adjustment can be obtained in terms of performance e.g. better insulation at the same total weight, or weight e.g. lower weight, at the same global insulating performance.

The resonance frequency of the mass-spring system and the radiation frequency of the mass layer formed by the top porous fibrous layer and the barrier layer result in different and independent effects on the IL curve. Both appear in the IL curve of a multilayer and produce a negative effect on the insulation performance, causing the presence of a dip in the IL curve. But two dips are normally observed in two separate sections of the IL curve. For the considered types of multilayers, the mass spring resonance frequency, also known as the resonance frequency is normally observed in the range of 200 to 500 (Hz), while the mass layer's radiation frequency, the radiation frequency, is in the range above approximately 800 (Hz). For clarity it is chosen to use two different terms ("resonance" and "radiation" frequency) to distinguish between the two different frequencies.

Although it is possible to make trim parts that have an ABA-type of configuration over all their surface, it is also possible to have trim parts with different areas dedicated to different acoustic functions (e.g. sole absorption, sole insulation) or even combined areas.

A trim part according to one embodiment is based on the idea that both insulating and absorbing areas are needed to fine-tune the sound attenuation in a car. By using the same porous fibrous layer throughout the whole area of the trim part for both the insulating area and the absorbing area, it is possible to integrate both functions in a trim part, preferably in separate areas. The skilled person knows from experience which areas need what type of acoustic function, and is now able to supply parts using this knowledge and at the same time using lower number of materials within one part. Also, he is able to design the part according to the needs. A trim part according to the invention has at least one absorbing area and one insulating area, however the actual number of areas per each acoustic function (insulation or absorption) and/or the size of the areas can differ depending on the part and the location where the part is used and last but not least depending on the actual requirements.

An absorbing area is defined as an area of the trim part that behaves predominantly as an absorber.

An insulating area is defined as an area on the trim part that behaves at least as a good insulator.

Porous Fibrous Layer

The use of porous fibrous materials, like felts or nonwovens, for the construction of acoustic absorbing parts is known, in particular in the case of the top absorber of an ABA system. The thicker the fibrous layer is, the better the acoustic absorption. However the negative effect of the absorbing top layer on the overall insulating performance is not known in the art, in particularly it is not known how to tune the characteristics of the porous fibrous layer to avoid this negative effect on the insulation and fully exploit the mass of the porous fibrous layer for sound insulation purposes.

It was found that the dynamic Young's modulus of the porous fibrous layer is related to the radiation frequency of the mass layer formed by the porous fibrous layer together with the barrier layer as follows:

$$E = 4\pi^2 \cdot t_p \cdot v^2 \cdot \frac{\frac{AW_b \cdot AW_p}{3} + \frac{AW_p^2}{12}}{AW_b + AW_p} \quad \text{(equation 1)}$$

with E being the dynamic Young's modulus (Pa) of the material constituting the porous fibrous layer, v being the radiation frequency (Hz), $AW_b$ being area weight (kg/m$^2$) of the impervious barrier layer, $AW_p$ being area weight (kg/m$^2$) of the porous fibrous layer and $t_p$ thickness (m) of the fibrous porous layer. According to this relation a proper value of the dynamic Young's modulus of the porous fibrous material enables the design of a trim part with the radiation frequency outside the frequency range of interest, and therefore an undisturbed insertion loss in the frequency range of interest. In particular, if the dynamic Young's modulus of the porous fibrous layer is higher than the minimum value defined as $$E_{min} = 4\pi^2 \cdot 10^{-6} \cdot t_p \cdot v_0^2 \cdot \frac{\frac{AW_b \cdot AW_p}{3} + \frac{AW_p^2}{12}}{AW_b + AW_p}$$

with $v_0$=3000 Hz, then the radiation frequency of the mass spring system will appear above the frequency range of interest for application of trim parts in vehicles, in particularly in the passenger compartment.

The frequency range of interest for insulation in a vehicle, especially when a certain weight from a mass-spring system is required, is in most cases up to and including about 3000 (Hz), however it can also be up to and including about 4000 (Hz) or even up to and including about 5000 (Hz) depending on the actual application and noise level requirements. For example when the need for insulation is in the frequency range up to 3000 (Hz), $v_0$ must equal 3000 (Hz) and, as a consequence, the dynamic Young's modulus should be at least $$118 \cdot t \cdot \frac{AW_b \cdot AW_p + AW_p^2/4}{AW_b + AW_p}$$

with $AW_b$ area weight (g/m$^2$) of the impervious mass layer. $AW_p$ area weight (g/m$^2$) of the porous fibrous layer and $t_p$ thickness (mm) of the porous fibrous layer. This gives a high dynamic Young's modulus at which the fibrous material cannot be compressed easily anymore.

A trim part according to the invention may contain a decoupling layer, and a mass layer composed of:

a porous fibrous layer with at least a dynamic Young's modulus of $$118 \cdot t \cdot \frac{AW_b \cdot AW_p + AW_p^2/4}{AW_b + AW_p} \text{ and,}$$

an impervious barrier layer with an Area Weight $AW_b$ (g/m$^2$) of at least 400 (g/m$^2$).

When all layers are laminated together to form one part, this trim part will have an IL equivalent to that of an acoustic mass spring system with a growth rate of approximately 12 dB/Octave, and according to the mass of the combined area weight of the barrier layer and the porous fibrous layer.

Moreover, the porous fibrous layer adds the absorption function, which was the original reason to introduce ABA systems and that is not available in the traditional mass-spring systems with a mass layer composed of impervious materials only. With the adjustment of the Young's modulus of the porous fibrous layer, the radiation frequency of the porous fibrous layer together with the barrier layer will fall above the frequency range of interest and no longer disturb the overall insulation performance of the system.

Compared to traditional ABA systems, the present disclosure differs in the fact that the top layer, or porous fibrous layer, in addition to the absorption function, participates actively to the insulation function of the system. This is possible only with a proper choice of the material characteristics and design of the material of the porous fibrous layer, as shown by equation (1) and as described in the examples.

The porous fibrous layer can be any type of felt material. It can be made from any thermo-formable fibrous materials, including those derived from natural and/or synthetic fibres. Preferably the felt is made of recycled fibrous material like shoddy cotton or other recycled fibres, like polyester.

Normally a fibrous material is produced in blanks, i.e. a semi-finished good in which the fibres are assembled together. Each blank is approximately homogeneous. A blank is composed by a sheet of material having an initial thickness and is characterized by its area weight, because the fibres are evenly distributed on the area. When a blank is formed, for example by compression, it assumes a final shape. Finally, a layer with a certain thickness is obtained. The area weight, i.e. the weight of the material in the unit area, is maintained after the forming process. From the same blank, several final thicknesses can be obtained, depending on the level of compression.

The dynamic Young's modulus of a fibrous material depends on several parameters. Firstly the characteristics of the material itself, i.e., the material composition, type and amount of fibres, type and amount of binders, etc. In addition for the same fibre recipe, it depends on the density of the material, which is linked to the thickness of the layer. Therefore, for a certain composition of felt, the dynamic Young's modulus can be measured at the different thicknesses and will consequently assume different values, normally increasing when the thickness is decreased (for the same initial blank).

The fibrous felt material may comprise a binding material, either as binding fibres or in resinous material, for instance thermoplastic or thermosetting polymers. In one embodiment, the fibrous felt material may include at least 30% epoxy resin or at least 25% bi-component binder fibres as the binding material. Other binding fibres or materials achieving the porous fibrous layer are possible and not excluded. The porous fibrous layer material can be obtained through a needling process, or any other process that increases the dynamic compression stiffness of the material.

In some embodiments, the area weight of the porous fibrous layer is between 500 and 2000 (g/m$^2$), for example between 800 and 1600 (g/m$^2$).

An additional restriction is normally also the available space in the car where the acoustical trim part can be put. This restriction is normally due to the carmaker, and the available space is in the range of maximum 20 to 25 (mm). All layers of the trim part must share this space. Therefore the thickness of the porous fibrous layer may be between 1 and 10 (mm), for example between 1 and 6 (mm). This leaves enough space for the decoupling layer. In particular the decoupling layer can vary in thickness to follow the 3-dimensional shape of the part that has to match with the space available in the car.

In the state of the art, highly compressed areas exist around the holes in the trim part, that are needed for throughput of cables or mounting fixtures. These latter areas are normally not dedicated to acoustic insulation as the acoustic weakness of the holes compromises any insulating characteristic in their close vicinity.

Barrier Layer

The mass layer between the porous fibrous layer and the decoupling layer must be impervious (air impermeable) to function as an ideal sound barrier. Only if the barrier layer is air impervious, the porous fibrous layer with the adjusted Young's modulus will function together with the barrier layer, as a mass layer for a spring-mass system. Although a heavy layer is provided in the examples, alternative non permeable mass barrier materials can be used.

If a heavy layer is used as the impervious barrier layer, it may have a thickness between 0.2 and 5 (mm), for example between 0.8 and 3 (mm). The area weight of the impervious mass layer is at least 0.4 (kg/m$^2$), preferably between 0.5 and 2 (kg/m2). However, the choice of the weight of the impervious barrier layer is linked to the design of the mass layer formed by the porous fibrous layer and the barrier layer together.

The impervious barrier layer can be made of highly filled dense materials which may include a thermoset plastic including ethylene vinyl acetate (EVA) copolymer, high density polyethylene, low density polyethylene, linear low density polyethylene, polypropylene, thermoplastic elastomer/rubber, polyvinyl chloride (PVC) or any combination of the foregoing.

The choice of the barrier material may be dependent on the porous fibrous layer and on the decoupling layer, and should be able to form a laminate binding all layers together. Also materials that are sprayed or glued can be used. However, after the binding and/or forming of the trim part, the mass barrier should be impervious to air in the final product.

If needed an adhesive layer in the form of a film, powder or liquid spray, as known in the art can be used to laminate the barrier layer with the porous fibrous layer or with the decoupling layer.

Combined Areas in the Trim Part

Normally, to reduce the sound pressure level in the passengers' compartment, a vehicle requires a good balance of the insulation and absorption provided by the acoustical trim parts. The different parts can have different functions (for example, insulation may be provided on the dash inner, absorption may be provided on the carpet). There is a current trend, however to achieve a more refined subdivision of the acoustical functions on the single areas, to optimize the global acoustical performance. As an example, a dash inner can be split in two parts, one providing high absorption and another providing high insulation. Generally, the lower part of the dash is more suitable for insulation, because the noise coming from the engine and the front wheels through this lower area is more relevant, while the upper part of the dash is more suitable for absorption, because some insulation is already provided by other elements of the car, for instance the instrumentation panel. In addition, the backside of the instrumentation panel will reflect sound waves coming through the part of the upper dash hidden behind the instrumentation panel itself. These reflected sound waves could be effectively eliminated using absorbing material. Similar considerations can be applied to other acoustical parts of the car. For instance the flooring: insulation is predominantly of use in the foot well areas and in the tunnel area, while absorption is predominantly of use underneath the front seat and in the rear floor panels.

The different local requirements can be covered by a sound insulating trim part divided in areas with at least one area with predominantly sound absorbing characteristics (absorbing area), whereby the absorbing area comprises at least one porous fibrous layer, and at least one other area with acoustic mass-spring characteristics (insulating area), whereby the insulating area consists of at least a mass layer and a decoupling layer. According to the present disclosure the mass layer consists of a porous fibrous layer with the dynamic Young's modulus adjusted to have the radiation frequency outside the frequency of interest at least above 3000 (Hz) and a barrier layer with at least 400 (g/m$^2$). For the absorbing area the same porous fibrous layer can be used. Therefore the porous fibrous layer is shared between the absorbing area and the insulating area with a first portion in the insulating area being with a Young's modulus adjusted in such a way to have a radiation frequency at least above 3000 (Hz) and a portion in the absorbing area optimized for maximum absorption. In general the thickness of the porous fibrous layer is higher in the absorbing area than in the insulating area.

The airflow resistance (AFR) of the porous fibrous layer in the absorbing area may be between 300 and 3000 (Nsm$^{-3}$), specifically between 400 and 1500 (Nsm$^{-3}$), A higher AFR is better for absorption. However since the airflow resistance decreases with increasing thickness, therefore the AFR may be between 400 and 1500 (Nsm$^{-3}$) for a thickness of between 8 and 12 (mm).

Adding additional absorbing layers and/or scrim layers may further enhance the absorption; either locally on the absorbing areas or as an additional layer on basically the whole trim part. The additional layers can be in the form of felt material similar or the same as used for the porous fibrous layer and/or additional scrim layers.

Intermediate areas may be disposed next to the absorbing areas and the insulating areas. The intermediate areas may form the areas between an insulating area and an absorbing area or around the rim of the part. These areas are less easy to identify as an absorbing area or insulating area mainly due to process conditions creating a type of intermediate zones with changing thickness, increasing in the direction of the absorbing zone and therefore behaving somewhere between a good absorber and a not so bad insulator.

Other types of intermediate areas can exist locally to follow the 3-dimensional shape of the part that has to match with the space available in the car. In the state of the art, highly compressed areas exist around the holes in the trim part that are needed for throughput of cables or mounting fixtures. These latter areas are normally not dedicated to acoustic insulation.

Decoupling Layer

The decoupling layer may include the standard materials used for the spring layer in a classic acoustic mass-spring system. The layer may be formed from any type of thermoplastic and thermosetting foam, closed or open, e.g. polyurethane foam. It can also be made from fibrous materials, e.g. thermo formable fibrous materials, including those derived from natural and/or synthetic fibres. The decoupling layer may have a low compression stiffness of less than 100 (kPa). Preferably the decoupling layer is also porous or open pored to enhance the spring effect. In principle the decoupling layer should be attached to the barrier layer over the entire surface of the part to have the most optimized effect, however due to the production technique, this might not be the case. As the part should function overall as an acoustical mass-spring system, small local areas were the layers are not coupled will not impair the overall attenuation effect.

The thickness of the decoupling layer can be optimized, however it is mostly dependent on space restrictions in the car. The thickness can be varied over the area of the part to follow the available space in the car. In some embodiments, the thickness may be between 1 and 100 (mm), for example between 5 and 20 (mm).

Additional Layers

An additional scrim can be put on top of the porous fibrous layer to enhance the acoustic absorption and/or to protect the underlying layers, for instance against water etc. An additional absorbing material can be put on top of the fibrous porous layer at least partially to further enhance the absorbing properties. The area weight of the additional layer is preferably between 500 and 2000 (g/m$^2$).

The absorbing layer may be formed from any type of thermoplastic and thermosetting foam, e.g. polyurethane foam. However for the purpose of absorbing noise the foam must be open pored and/or porous to enable the entrance of sound waves according to the principles of sound absorption, as known in the art. The absorbing layer can also be made from fibrous materials, e.g. thermo formable fibrous materials, including those derived from natural and/or synthetic fibres. It can be made of the same type of material as the fibrous porous layer but preferably has to be lofty to prevent interference in the insulation properties. The airflow resistance (AFR) of the absorbing layer may be at least 200 ($Nsm^{-3}$), for example between 500 and 2500 ($Nsm^{-3}$). Also absorbing systems with more than one absorbing layer can be put on top of the porous fibrous layer.

Also an additional scrim can be put on top of either the absorbing material or the porous fibrous layer to enhance even further the acoustic absorption and/or to protect the underlying layers, for instance against water etc. A scrim is a thin nonwoven layer with a thickness between 0.1 and around 1 (mm), preferably between 0.25 and 0.5 (ram). It has preferably an airflow resistance (AFR) of between 500 and 3000 ($Nsm^{-3}$), more preferably of between 1000 and 1500 ($Nsm^{-3}$). Whereby the scrim and the underlying absorbing layer may differ in AFR, to obtain an increased absorption. For example, the AFR of the scrim may from the AFR of the porous fibrous layer.

The area weight of the scrim layer can be between 50 and 250 ($g/m^2$), for example between 80 and 150 ($g/m^2$).

The scrim layers can be made from continuous or staple fibres or fibre mixtures. The fibres can be made by meltblown or spunbond technologies. They can also be mixed with natural fibres. The scrims are for example made of polyester, or polyolefin fibres or a combination of fibres, for instance of polyester and cellulose, or polyamide and polyethylene, or polypropylene and polyethylene.

These and other characteristics of the invention will be clear from the following description, given as non-restrictive examples with reference to the attached drawings.

Production Method

The trim part can be produced with cold and/or hot moulding methods commonly known in the art. For instance the porous fibrous layer, with or without the barrier layer, can be formed to obtain a material with the dynamic Young's modulus properties adjusted. The decoupling layer can be either injection moulded, or a foam or fibre layer can be added to the backside of the barrier layer.

Mechanical and Compression Stiffness and Measurement

Mechanical stiffness is linked to the reaction that a material offers to an external stress excitation. Compression stiffness is related to a compression excitation, and bending stiffness is related to a bending excitation. The bending stiffness relates the applied bending moment to the resulting deflection. On the other hand, the compression or normal stiffness relates the applied normal force to the resulting strain. For a homogeneous plate made with an isotropic material, it is the product of the elastic modulus E of the material and the surface A of the plate.

For a plate made with an isotropic material both compression and bending stiffness relate directly to the material's Young's modulus and therefore it is possible to calculate one from the other. However, if the material is not isotropic, as it is the case for most felts, these relationships no longer apply since bending stiffness is linked mainly to the in-plane material's Young's modulus, while compression stiffness is linked mainly to the out-of-plane Young's modulus. Therefore, it is not possible any more to calculate one from the other. In addition, both compression stiffness and bending stiffness can be measured in static or dynamic conditions and are in principle different in static and dynamic conditions.

The radiation of a layer of material is originated from the vibrations of the layer orthogonal to its plane and is mainly linked to the dynamic compression stiffness of the material. The dynamic Young's modulus of a porous material was measured with the commercially available "Elwis-S" device (Rieter Automotive AG), in which the sample is excited by a compression stress. The measurement using Elwis-S is described for instance in BERTOLINI, et al. Transfer function based method to identify frequency dependent Young's modulus, Poisson's ratio and damping loss factor of poroelastic materials. *Symposium on acoustics of poro-elastic materials* (*SAPEM*), *Bradford*, December 2008.

As these types of measurements are not generally used yet for porous materials, there exists no official NEN or ISO norm. However other similar measurement systems are known and used, based on similar physical principles, as described in detail in: LANGLOIS, et al. Polynomial relations for quasi-static mechanical characterization of isotropic poroelastic materials. *J. Acoustical Soc. Am,* 2001, vol. 10, no. 6, p. 3032-3040.

A direct correlation of a Young's modulus measured with a static method and a Young's modulus measured with a dynamic method is not straightforward and in most of the cases meaningless because the dynamic Young's modulus is measured in the frequency domain over a predefined frequency range (for example 300-600 Hz) and the static value of the Young's modulus corresponds to the limit-case of 0 (Hz), which is not directly obtainable from dynamic measurements.

For the current invention the compression stiffness is important and not the static mechanical stiffness normally used in the state of the art.

Measurements

Airflow resistance was measured according to ISO9053.

The area weight and thickness were measured using standard methods known in the art.

The transmission loss (TL) of a structure is a measure of its sound insulation. It is defined as the ratio, expressed in decibels, of the acoustic power incident on the structure and the acoustic power transmitted by the structure to the receiving side. In the case of an automotive structure equipped with an acoustical part, transmission loss is not only due to the presence of the part, but also to the steel structure on which the part is mounted. Since it is important to evaluate the sound insulation capabilities of an automotive acoustical part independently from the steel structure on which it is mounted, the insertion loss is introduced. The insertion loss (IL) of an acoustical part mounted can a structure is defined as the difference between the transmission loss of the structure equipped with the acoustical part and the transmission loss of the structure alone:

$$IL_{part}=TL_{part+steel}-TL_{steel}(dB)$$

The insertion loss and the absorption coefficient were simulated using SISAB, a numerical simulation software for the calculation of the acoustical performance of acoustical parts, based on the transfer matrix method. The transfer matrix method is a method for simulating sound propagation in layered media and is described for instance in BROUARD B., et al. A general method for modelling sound propagation in layered media, *Journal of Sound and Vibration.* 1995, vol. 193, no. 1, p. 129-142.

DETAILED DESCRIPTION

Figure 1:
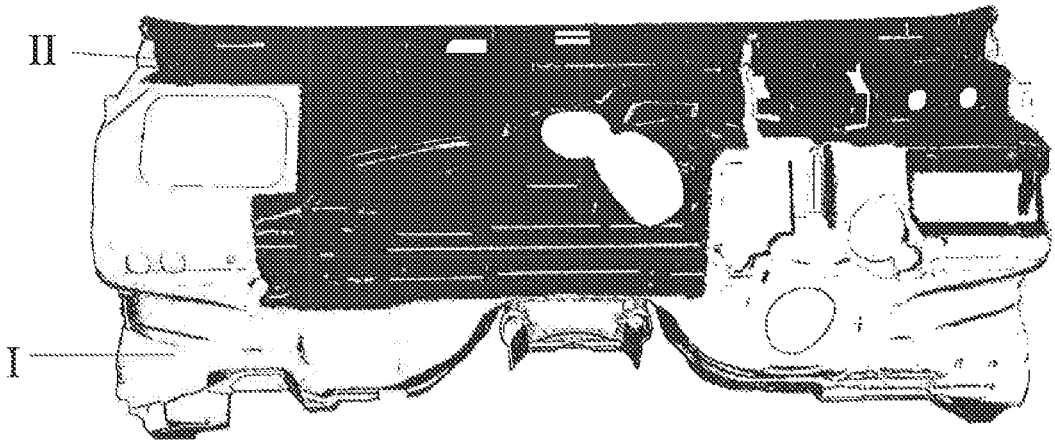
FIG. 1 is a diagrammatic and schematic illustration of an exemplary inner dash trim part with regions of sound insulation and regions of sound absorption.

FIG. 1 shows an example of an inner dash part with two separate areas having different acoustic functions, optimized to obtain a compromise of insulation and absorption. Generally, the lower part of an inner dash part is more suitable for insulation (I), because the noise paths coming from the engine and the front wheels through this lower area are more relevant, while the upper part of the dash (II) is more suitable for absorption, because some insulation is already provided by other elements of the car, for example the instrumentation panel. Between these areas, in areas where the packaging space is minimal or in heavily 3 dimensional shaped areas, it is normally not possible to identify the actual acoustical characteristics. For instance, it is not possible to identify acoustical characteristics due to either impairing of the decoupling layer or compression of a lofty layer that should function as an absorbing layer.

To achieve an overall better sound attenuation for an inner dash trim part the whole part can be built with different distinctive areas:

1. the insulating area (I) can be formed by combining a impervious barrier layer and a first portion of a porous fibrous layer with adjusted dynamic Young's modulus and a decoupling layer to form the alternative ABA system with the exploitation of the total mass of the two top layers functioning together as a single mass layer for the mass spring system, and the porous fibrous layer adding absorbing properties as well as preventing direct sound reflection, and
2. the absorbing area (II) can be formed by the portion of the porous fibrous layer not adjusted for insulation.

Thus area I of the trim part in the inner dash shown in FIG. 1 contains the alternative ABA system. Area II would contain the porous fibrous layer functioning as a standard absorber as is known in the art.

Figure 2:
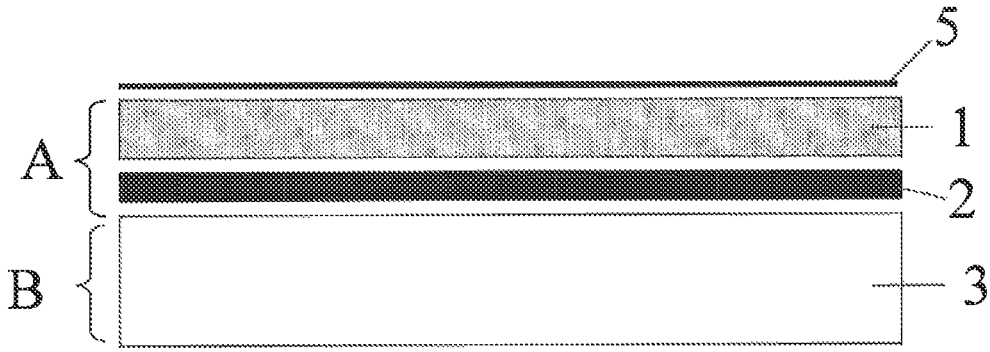
FIGS. 2, 3, 4 and 5 are schematic illustrations of exemplary materials of a trim part according to the invention.

FIG. 2 shows a schematic cross section of the trim part with a mass layer A consisting of the combination of the barrier layer 2 and of the porous fibrous layer 1, and with a spring layer B consisting of a decoupling layer 3. Together mass layer A and spring layer form an acoustic ABA system. Sound-insulating characteristics can be expected coming from the combined mass of the barrier layer and of the porous fibrous layer. In addition the porous fibrous layer 1 will maintain absorbing properties. Preferably an additional scrim layer 5 can be put on top of the porous fibrous layer 1 to enhance the sound absorbing effect even further.

Figure 3:
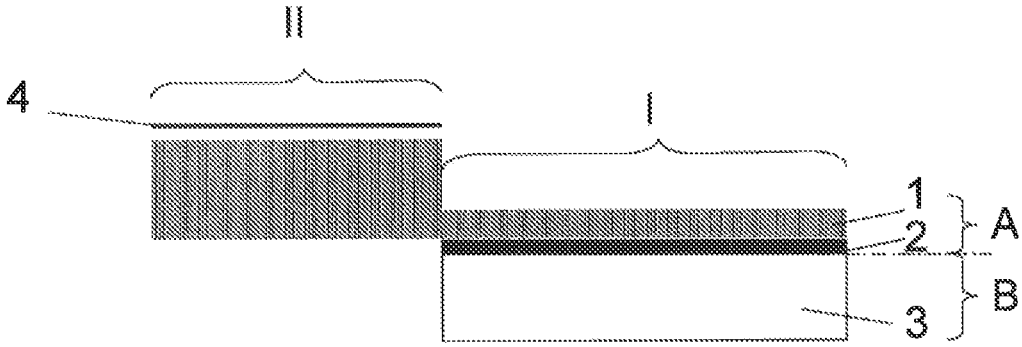

FIG. 3 shows a schematic cross section of a multilayer. The multilayer may contain at least an area with sound insulating characteristics (I), called an insulating area, and an area with sound absorbing characteristics (II), called an absorbing area. The location of the areas on the part may depend on where the part is used on the vehicle and on the expected noise levels and frequency characteristics in that specific area. (See as an example the inner dash previous described.)

The insulating area (I) and the absorbing area (II) have at least the same porous fibrous layer (1), whereby the portion of the porous fibrous layer in the insulating area is compressed to form a rigid layer (1), such that the dynamic Young's modulus of the material constituting this porous fibrous layer is adjusted to have the radiation frequency above at least 3000 (Hz). The minimum value of the Young's modulus of the material constituting the porous fibrous layer necessary for such behaviour is given by the formula $$118 \cdot t \cdot \frac{AW_b \cdot AW_p + AW_p^2/4}{AW_b + AW_p}$$

When this condition is fulfilled, the combined layer formed by the porous fibrous layer and the barrier layer may act as a rigid mass and guarantee the optimal insulation performance.

The insulation characteristic is formed with a mass layer A consisting of the barrier layer 2 and the porous fibrous layer 1, and with a spring layer B consisting of a decoupling layer (3), together forming an acoustic mass-spring system, In Area I a predominant sound-insulating characteristic can be expected accordingly.

In area II the porous fibrous layer 1 does not have the Young's modulus according to Equation 1, but enables sound absorbing characteristics in this area. Preferably an additional scrim layer (4) can be put on top of the absorbing layer to enhance the sound absorbing effect even further.

Figure 4:
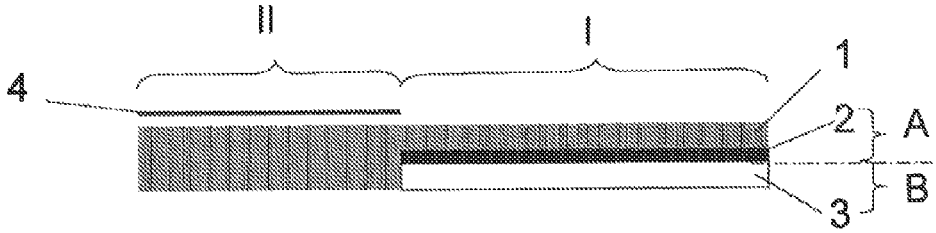

FIG. 4 shows an alternative multilayer, based on the same principles as in FIG. 3 (see there for reference). The difference is that the area underneath the compaction is used for the addition of the barrier layer and the decoupling layer, producing amore even part. In practice the part may be a crossover between FIGS. 3 and 4, in particularly the shape of automotive trim parts is normally a 3D form and this will influence the final layout of the layering as well. Also between the insulating area and the absorbing area there will not be clear-cut boundaries, rather intermediate areas.

Figure 5:
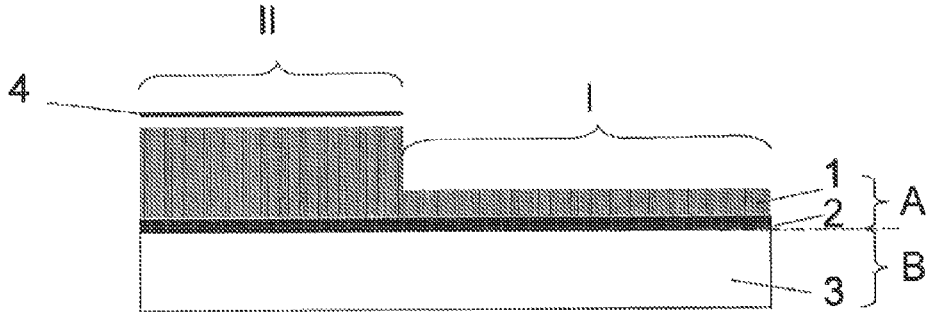

FIG. 5 shows an alternative layering where the barrier and the decoupler are available over the whole surface of the part, including the absorbing area. This can have advantages from a process viewpoint, reducing the amount of production steps and/or manual labour involved in using patches instead of full covering layers throughout the part.

The insertion loss and the sound absorption of different noise attenuation multilayer constructions of the state of the art were measured or simulated using measured material parameters and compared with the insertion loss and sound absorption of a noise attenuation multilayer according to the invention. To have a direct comparison, for all samples the same foam decoupler with a density of 56 (kg/m$^3$) and a thickness of 14 (mm) was used.

Comparative sample A is a classic mass-spring systems with the mass layer formed by an EPDM heavy layer material of 3 (kg/m$^2$) and injected foam as the decoupling layer. The total area weight of sample A was 3840 (g/m$^2$).

Comparative sample B is an ABA system according to the state of the art with the mass layer formed by an EPDM heavy layer material of 3 (kg/m$^2$) and injected foam as the decoupling layer. On top, an additional cotton felt layer with 30% bicomponent binder fibres was used. The area weight of the felt layer is 1000 (g/m$^2$) and the thickness 9.8 (mm). Therefore the total area weight of the combination of the top felt layer and barrier layer would be 4 (kg/m$^2$), The total area weight of sample A was 4960 (g/m$^2$).

Comparative sample C is also an ABA system according to the state of the art, with 400 (g/m$^2$) of a lofty fleece with a thickness of 11 (mm) glued on top of the same mass spring system as used in the previous comparative samples. The total area weight of the combination of the top felt layer and barrier layer together is 3.4 (kg/m$^2$).

Figure 6:
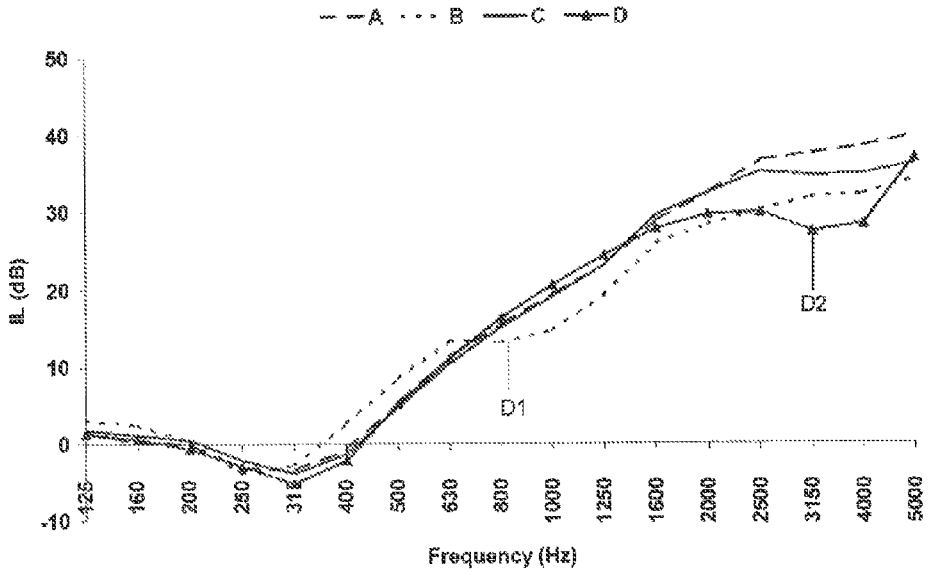
FIG. 6 is a graph showing insertion loss curves of Sample A-D.

FIG. 6 shows the insertion loss (IL) curves of the comparative samples A, B and C and sample D. The simulated insertion loss shown is the transmission loss of the system constituted by the multilayer and the steel plate on which it is applied minus the transmission loss of the steel plate itself.

FIG. 6 shows the IL curves of all the state of the art systems. Sample A is the classic mass spring system with a growth rate of 12 dB/Octave as expected and it is used here as reference. Sample B has a total weight for both top layers of 4 (kg/m$^2$) and would be expected to show an insertion loss above reference sample A. However this is only true for the low frequency range below 630 (Hz). Above 630 (Hz) the overall insertion loss deteriorates to a performance even under the insertion loss expected for a 3 (kg/m$^2$) mass layer. The additional weight used for the top absorbing layer does not contribute to the overall insulation performance at all, it even negatively affects the insertion loss of the underlying mass spring system.

The dynamic Young's modulus of the felt of sample B at 10 (mm) was measured and is 108000 (Pa), According to equation (1), the heavy layer and the felt porous layer together will have a radiation frequency around 980 (Hz). In fact, a dip D1 is observed in FIG. 6 for curve B. The dip D1 is in the curve between 800 and 1000 (Hz) for a calculation in third octave bands. The radiation frequency is in this case clearly within frequency range of primary interest for noise attenuation in vehicles.

Also in comparative Sample C it would be expected that the addition of the fleece layer on top of the heavy layer would lead to some increase of the IL curve. Nevertheless, the IL curve of sample C is practically equal to the one of the underlying mass-spring system (i.e. Sample A). Also for this sample the increase in weight does not lead to any increase in the observed acoustic insulation. In this case the fleece top layer does not contribute to the insulation performance at all.

Sample D is made according to the invention with a mass layer consisting of a porous fibrous layer of 1500 g/m$^2$ on top of a barrier layer with an area weight of 1500 (g/m$^2$) and of a decoupling layer, the Young's modulus of the porous fibrous layer being adjusted in such a way that the radiation frequency of the barrier layer and the porous fibrous layer together is at least above 3000 (Hz). The insertion loss shows the same 12 dB/octave growth rate as well as the same level of the insertion loss of sample A over at least a large part of the frequency range of interest.

As the overall weight of the mass layer for sample D is comparable with reference sample A—both being 3 (kg/m$^2$)—it is here clearly shown that the full potential of the top absorbing layer can be used for the overall insulation performance of the sample according to the invention.

The dynamic Young's modulus of the felt of sample D at 3.5 (mm) was measured and is 550000 (Pa). The minimum Young's modulus of the porous fibrous layer that is necessary to have a radiation frequency above 3000 (Hz) for sample D, according to the formula $$118 \cdot t \cdot \frac{AW_b \cdot AW_p + AW_p^2/4}{AW_b + AW_p}$$

is 390000 (Pa). Since the measured Young's modulus is greater than the minimum required Young's modulus, the porous fibrous layer together with the barrier layer will act as a mass in a mass-spring system in the frequency range of interest. According to equation (1), the heavy layer and the felt porous layer together will have a radiation frequency around 3600 (Hz). In fact, a dip D2 is observed in FIG. 6 for curve D. The dip D2 is in the curve between 3150 and 4000 (Hz) for a calculation in third octave bands. The dip appears at a frequency above 3000 (Hz) and is outside the frequency range of primary interest for noise attenuation in vehicles.

Figure 7:
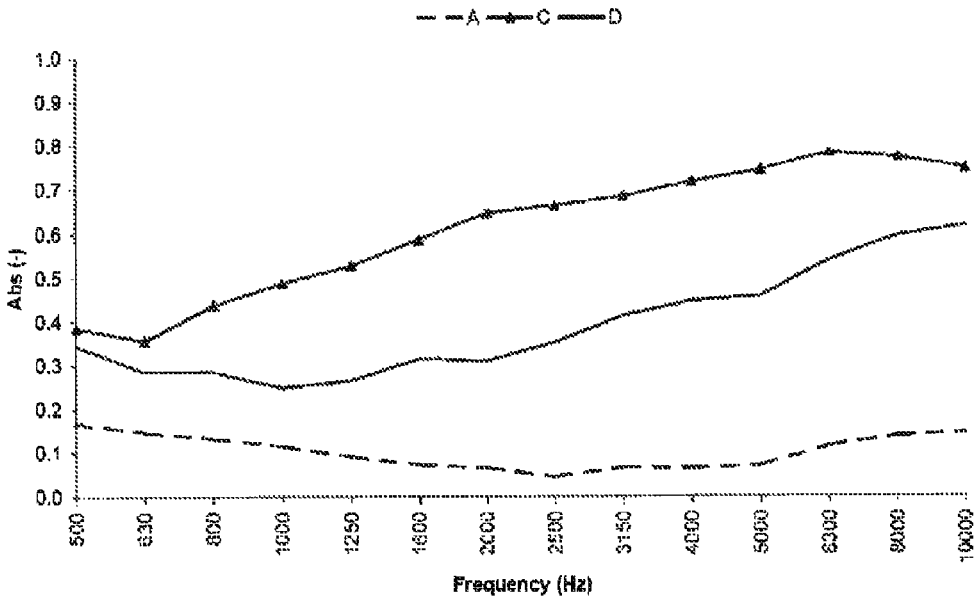
FIG. 7 is a graph showing absorption curves of Sample A-D.

FIG. 7 shows the absorbing curves of the same comparative sample A and C as well as for sample D. The results show that a classic mass-spring layer—sample A—does not show any noticeable sound absorption. While the floppy fleece, at a thickness of 11 (mm) shows a good absorption. Surprisingly sample D according to the invention, having a thickness of the porous fibrous layer of 15 (mm), still shows an average sound absorption. Now it is known that for increasing by 1 (dB) the overall sound attenuation one needs a lower increase in weight for an insulation system and a considerably larger increase when an absorption system is chosen. Therefore the overall increase in attenuation that can be achieved by using the full weight potential of the materials used, more than compensates for the minor loss in absorption properties.

The design of a mass layer may involve the following steps.

1. A felt composition and an area weight are chosen.
2. A barrier layer and its area weight are chosen.
3. The sum of these two area weights will provide the overall mass of the mass spring system.
4. The two materials are then formed, in a way that each material assumes the shape of a layer and assumes a certain thickness.
5. The area weight ($AW_p$, g/m$^2$) and the thickness ($t_p$, mm) of the formed porous fibrous layer are measured. The area weight ($AW_b$, g/m$^2$) of the formed barrier layer is measured.
6. The Young's modulus of the porous fibrous layer is measured through Elwis-S, for a formed sample at the thickness $t_p$ (measured Young's modulus: $E_{meas}$).
7. The minimum necessary Young's modulus ($E_{min}$) is calculated by the formula $$118 \cdot t \cdot \frac{AW_b \cdot AW_p + AW_p^2/4}{AW_b + AW_p},$$

for $AW_p$, $AW_b$ and $t_p$ the measured data of point 5 are taken. In this example the radiation frequency is taken to be at least above 3000 (Hz).

8. It has to be verified that the condition $E_{meas} > E_{min}$ is fulfilled.

If the condition is fulfilled, the choice of the material is satisfactory and the fibrous material can be used at the determined thickness together with the chosen barrier layer, the two may act together as a mass layer in a mass spring system. Otherwise, the choice of the parameters and in particular the choice of the Young's modulus of the felt has to be changed and re-iterated, restarting from one of the points 1 to 4, where the parameters (felt composition and/or felt area weight and/or felt thickness and/or mass barrier area weight) must be changed. Generally, the choice of the barrier area weight alone is not enough to produce a proper mass layer. If the condition is not fulfilled, in most of the cases the parameters of the felt have to be properly chosen, in particular the dynamic Young's modulus.

In the following, the above described design process is further explained with an example.

Figure 8:
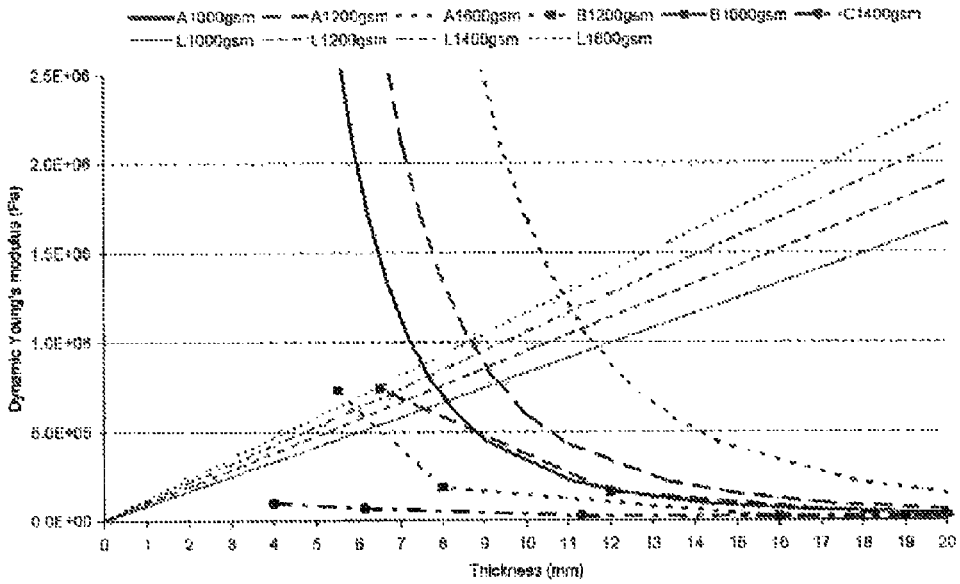
FIG. 8 is a graph of the dynamic Young's modulus in relation to the area weight and the thickness of the porous fibrous layer.

FIG. 8 shows a graph of dynamic Young's modulus vs. thickness for the insulating mass layer according to the invention. In this case a felt layer made primarily of recycled cotton with 30% phenolic resin was taken. This material was used until not long ago as decoupler or absorbing layer, mainly in multilayer configurations. It is here not chosen as a restrictive sample but more as an example to show how to technically design the material according to the invention.

In FIG. 8, line L1000*gsm* shows, as a function of the layer's thickness, the minimum dynamic Young's modulus that a porous fibrous layer with an area weight of 1000 (g/m$^2$) must have to be according to the invention. This was calculated with the formula $$4\pi^2 \cdot 10^{-6} \cdot t_p \cdot \nu^2 \cdot \frac{\frac{AW_b \cdot AW_p}{3} + \frac{AW_p^2}{12}}{AW_b + AW_p}$$

for a radiation frequency of 3000(Hz) and an Area weight for the heavy layer of 1500 (g/m$^2$) and it is shown then in FIG. 8 as a straight line. Lines L1200*gsm*, L1400*gsm* and L1600*gsm* in the same figure show similar data for the area weights of the porous fibrous layer of 1200, 1400 and 1600 (g/m$^2$). The dynamic Young's modulus of a porous fibrous layer with a given thickness and one of these area weights should be above the line corresponding to its area weight, to make sure that the radiation frequency is shifted to at least 3000 (Hz) and thus outside of the frequency range of primary interest for noise attenuation in vehicles.

In FIG. 8, line A1000*gsm* shows, as a function of the layer's thickness, the measured dynamic Young's modulus of a layer of primarily cotton felt with 30% phenolic resin having an area weight of 1000 (g/m$^2$). In the same figure lines A1200*gsm*, A1600*gsm* show similar data for the area weights of 1200 (g/m$^2$) and 1600 (g/m$^2$) respectively. For certain points the dynamic Young's modulus was measured and the behaviour as depicted was extrapolated from these measurements. This material shows a quick increase in the dynamic Young's modulus already showing a radiation frequency above 3000 (Hz) at an area weight of 1000 (g/m$^2$) and a thickness of around 7.7 (mm). However due to space restrictions this thickness would not be preferred in the interior of a car for instance for an inner dash.

In FIG. 8, line L1200*gsm* shows, as a function of the layer's thickness, the dynamic Young's modulus of a layer of primarily cotton felt material with 30% epoxy resin and an area weight of 1200 (g/m$^2$). Line B1600*gsm* shows similar data for the case of the area weight of 1600 (g/m$^2$). For certain points the dynamic Young's modulus was measured and the behaviour as depicted was extrapolated from these measurements. If one compares these data with those for phenolic resin felt discussed before, it is clearly visible that the binding material has an effect on the compression stiffness of the material and hence on the dynamic Young's modulus at a certain area weight and thickness.

Line C1400*gsm* shows, as a function of the layer's thickness the dynamic Young's modulus of a layer of primarily cotton felt material bound with 15% bi-component binding fibres and having an area weight of 1400 (g/m$^2$). For certain points the dynamic Young's modulus was measured and the behaviour as depicted was extrapolated from these measurements.

In a set of samples, the influence of binder material, in particular the type and amount of binder is looked at in more detail.

FIG. 8 shows the influence of binder material, in particular the type and amount of binder. In addition, FIG. 8 explains how a porous fibrous layer is selected and adjusted.

For example, the curves B1200*gsm* and L1200*gsm* are considered. The line L1200*gsm* is drawn considering an area weight of the barrier layer ($AW_b$) of 1500 (g/m$^2$). At a thickness of 8 (mm), the porous fibrous layer has a measured dynamic Young's modulus of 187000 (Pa), given by the curve B1200*gsm*. The lower limit for the Young's modulus according to the invention, to have a radiation frequency above 3000 (Hz), is given by the line L1200*gsm* and is set at 757000 (Pa) at 8 (mm). Therefore, at 8 (mm) the layer of primarily cotton felt material with 30% epoxy resin and an area weight of 1200 (g/m$^2$) will have a radiation frequency below 3000 (Hz) and will not function. In fact, according to equation (1) the material at 8 (mm) will have a radiation frequency at 1500 (Hz). At a thickness of 5.5 (mm), the porous fibrous layer has a measured dynamic Young's modulus of 730000 (Pa), given by the curve B1200*gsm*. The lower limit for the Young's modulus, to have a radiation frequency above 3000 (Hz), is given by the line L1200*gsm* and is set at 520000 (Pa) at 5.5 (mm). Therefore, at 5.5 (mm) the layer of primarily cotton felt material with 30% epoxy resin and an area weight of 1200 (g/m$^2$) will have a radiation frequency above 3000 (Hz) and will function. In fact, according to equation (1) the material at 5.5 (mm) will have a radiation frequency at 3600 (Hz).

In summary, FIG. 8 shows also how, once the area weight of the barrier layer is fixed, to choose and adjust the characteristics of the porous fibrous layer (material type, area weight, thickness) in order to have a Young's modulus according to the present disclosure.

When the porous fibrous layer is chosen and its Young's modulus is adjusted, a surprising insulation effect is obtained, that is not strongly related to the AFR of the top layer. On the other hand, it was found that the driving factor to obtain a consistent insulation without any dip effect in the range of frequency of interest for instance for automotive applications, is the Young's modulus of the top layer according to the present disclosure.

When the thickness of the upper layer is changed, both the AFR and the Young's modulus change and, in general, both the AFR and the Young's modulus are increasing when the thickness of the layer is decreased. However, the value of each of those parameters is related to the characteristics of the material. The AFR and the Young's modulus, as well as other acoustical and mechanical parameters of a porous material, are not only a function of the thickness.

As an example, the AFR of two comparable felt materials with the same thickness are compared. An "air laid" felt normally used for automotive application with an area weight of 1000 g/m$^2$ shows an AFR of 3200 Nsm$^{-3}$ at approximately 2.5 mm. The same material at a thickness of 6 mm shows an AFR of 1050 Nsm$^{-3}$. In comparison a "needled" felt normally used for automotive applications, having approximately the same area weight of 1000 g/m$^2$ shows an AFR 220 Nsm$^{-3}$ at approximately 6 mm. At the same thickness, the two materials have different AFR. The two felts mainly differ in the way the fibres are processed to form a layer of material and this has an impact on the Ma.

The same consideration applies for the Young's modulus: for every material, the Young's modulus is increasing when the thickness is decreasing, however two different materials at the same thickness do not necessarily have the same value of the Young's modulus and can be characterized by very different Young's moduli, depending mainly on their composition and on the way they are produced.

Moreover, the AFR and the Young's modulus are independent parameters, the first being linked to the acoustical characteristics of the material and the one being linked to the mechanical characteristics of the material. As an example, two materials with the same AFR (linked, for example, to a similar distribution of the fibres in the materials) can have a different Young's modulus (linked, for example, to a different amount of binders in the material) and therefore a different performance.

As can also be seen from the materials depicted certain materials are not suitable to form the mass layer according to the present disclosure, basically because they must be compressed to a thickness no longer possibly achievable or at a cost of extreme high pressure forces, making the process no longer cost effective. However by adjusting the ratio of binding material vs. fibrous material, the binding material used, and the area weight and or thickness it is possible to design materials suitable to be used as a porous fibrous mass layer according to the present disclosure.

By adjusting the dynamic stiffness of the material constituting the top porous fibrous layer together with the area weight of the barrier layer, according to equation as disclosed, the radiation frequency of the mass layer formed by the combination of the porous fibrous layer and the barrier layer is shifted outside of the primary range of interest for automotive applications and, at the same time, an additional mass effect thanks to the presence of the porous fibrous layer is obtained. The increase of overall insertion loss IL depends on the area weight of the porous fibrous layer together with the area weight of the barrier layer and can be estimated with reasonable approximation.

The sound insulating trim part, whereby the barrier layer is between the porous fibrous layer and the decoupling layer and all layers are laminated together, can be used in a car for instance as an inner dash as described previously. However it can also be used as a floor covering, eventually with a decorative layer or a carpet layer on top, whereby the carpet layer is preferably a porous system for instance a tufted carpet or a nonwoven carpet. It can also be used in outer or inner wheel liners. All applications can be in vehicles like a car or a truck.

The invention claimed is:

1. A sound attenuating trim part, comprising:

at least one insulating area having acoustic mass-spring characteristics and comprising:

a decoupling layer; and at least one mass layer adjacent to the decoupling layer comprising:

a porous fibrous layer; and a barrier layer located between the porous fibrous layer and the decoupling layer, wherein:

the decoupling layer, the porous fibrous layer, and the barrier layer are all laminated together; and the porous fibrous layer, at least in the insulating area, is adjusted to have a dynamic Young's modulus (Pa) of at least approximately:

$$4\pi^2 \cdot 10^{-6} \cdot t_p \cdot v^2 \cdot \frac{\frac{AW_b \cdot AW_p}{3} + \frac{AW_p^2}{12}}{AW_b + AW_p};$$

and where:

$AW_b$ is an area weight (g/m$^2$) of the barrier layer, $AW_p$ is an area weight (g/m$^2$) of the porous fibrous layer, $t_p$ is a thickness (mm) of the porous fibrous layer, and v (Hz) is a radiation frequency of at least 3000 (Hz), and the barrier layer has an area weight of at least 400 (g/m$^2$).

2. The part according to claim 1 further comprising:

at least one absorbing area with sound absorbing characteristics comprising at least a portion of the porous fibrous layer and wherein a thickness of a portion of the porous fibrous layer in the absorbing area is larger than a thickness of a portion of the porous fibrous layer in the insulating area.

3. The part according to claim 1, wherein the area weight $AW_p$ of the porous fibrous layer is between 400 and 2000 (g/m$^2$).

4. The part according to claim 1, wherein the thickness $t_p$ of the porous fibrous layer is between 1 and 10 (mm) in the insulating area.

5. The part according to claim 1, wherein at least a portion of an additional absorbing layer contacts the porous fibrous layer.

6. The part according to claim 5 wherein, the at least a portion of the additional absorbing layer is covered with a scrim layer.

7. The part according to claim 1, wherein the area weight of the barrier layer is between 500 and 2000 (g/m$^2$).

8. The part according to claim 1, wherein the porous fibrous layer is at least partially covered with a scrim layer.

9. The part according to claim 5, wherein at least one of a decorative layer or a carpet layer contacts at least one of the porous fibrous layer and the additional absorbing layer.

10. The part according to claim 1, wherein the part is used as at least one of an insulator, a combined insulator and absorber, an automotive trim part, a floor covering, or a wheel liner in a vehicle.

* * * * *